US011320246B2

(12) United States Patent
Berg

(10) Patent No.: US 11,320,246 B2
(45) Date of Patent: May 3, 2022

(54) PENETRATOR AND SUB-CALIBER PROJECTILE

(71) Applicant: RHEINMETALL WAFFE MUNITION GmbH, Unterluess (DE)

(72) Inventor: Martin Berg, Celle (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 150 days.

(21) Appl. No.: 15/947,238

(22) Filed: Apr. 6, 2018

(65) Prior Publication Data

US 2018/0224251 A1 Aug. 9, 2018

Related U.S. Application Data

(63) Continuation of application No. PCT/EP2016/072896, filed on Sep. 27, 2016.

(30) Foreign Application Priority Data

Oct. 6, 2015 (DE) ..... 10 2015 117 018.3

(51) Int. Cl.

| | |
|---|---|
| ***F42B 12/06*** | (2006.01) |
| ***F42B 12/08*** | (2006.01) |
| ***F42B 12/74*** | (2006.01) |
| ***F42B 10/04*** | (2006.01) |
| ***F42B 14/06*** | (2006.01) |
| ***F42B 33/00*** | (2006.01) |

(52) U.S. Cl.

CPC ..... *F42B 12/06* (2013.01); *F42B 12/08* (2013.01); *F42B 12/74* (2013.01); *F42B 14/06* (2013.01); *F42B 33/001* (2013.01); *F42B 10/04* (2013.01)

(58) Field of Classification Search

CPC ..... F42B 12/06; F42B 12/08; F42B 12/74; F42B 10/04; F42B 14/06; F42B 33/00; F42B 33/001; F42B 14/061

USPC ..... 102/518, 519, 520, 521, 522, 523

See application file for complete search history.

(56) References Cited

U.S. PATENT DOCUMENTS

| | | | | |
|---|---|---|---|---|
| 4,665,828 | A | 5/1987 | Auer | |
| 4,708,064 | A | 11/1987 | Bisping et al. | |
| 4,716,834 | A * | 1/1988 | Wallow | F42B 12/06 102/519 |

(Continued)

FOREIGN PATENT DOCUMENTS

| | | |
|---|---|---|
| DE | 2743732 A1 | 7/1986 |
| DE | 39 12 123 A1 | 3/1990 |

(Continued)

OTHER PUBLICATIONS

International Search report for PCT/EP2016/072896 (dated 2016).*

(Continued)

*Primary Examiner* — James S Bergin

(74) *Attorney, Agent, or Firm* — Muncy, Geissler, Olds & Lowe, P.C.

(57) ABSTRACT

A penetrator and a sub-caliber ammunition or projectile accommodating said penetrator. The penetrator according to the invention is characterized by the fact that the penetrator has an interface in the front area. Via said geometric interface, a basic penetrator devised in according to the invention can be provided having different penetrator tips and completed to form an individual KE penetrator.

16 Claims, 3 Drawing Sheets

(56) References Cited

U.S. PATENT DOCUMENTS

| | | | | | |
|---|---|---|---|---|---|
| 4,770,102 | A * | 9/1988 | Bisping | F42B 12/06 | 102/521 |
| 4,901,645 | A * | 2/1990 | Bisping | F42B 12/06 | 102/501 |
| 5,088,416 | A | 2/1992 | Sabranski | | |
| 5,223,667 | A * | 6/1993 | Anderson | F42B 10/08 | 102/517 |
| 6,659,013 | B1 | 12/2003 | Kellner | | |
| 6,662,726 | B1 * | 12/2003 | Steiner | F42B 12/06 | 102/517 |
| 6,843,179 | B2 * | 1/2005 | Hunn | F42B 10/02 | 102/518 |
| 7,036,434 | B1 * | 5/2006 | Vo | F42B 12/06 | 102/503 |
| 7,270,060 | B1 * | 9/2007 | Manole | F42B 12/06 | 102/520 |
| 7,819,065 | B2 | 10/2010 | Haeselich | | |
| 8,522,687 | B2 * | 9/2013 | Liu | F42B 12/72 | 102/517 |
| 8,561,544 | B2 | 10/2013 | Baumann et al. | | |
| 8,869,704 | B2 * | 10/2014 | Eches | F42B 12/06 | 102/521 |
| 8,985,026 | B2 * | 3/2015 | Volkmann | F42B 12/06 | 102/519 |
| 2011/0176951 | A1 | 7/2011 | Beister et al. | | |
| 2011/0214582 | A1 | 9/2011 | Glasser | | |
| 2013/0125774 | A1 | 5/2013 | Volkmann | | |

FOREIGN PATENT DOCUMENTS

| | | | | | |
|---|---|---|---|---|---|
| DE | 3911575 | A1 * | 10/1990 | F42B 12/76 | |
| DE | 4022462 | A1 * | 1/1992 | F42B 10/06 | |
| DE | 4023482 | A1 | 1/1992 | | |
| DE | 4214873 | A1 * | 11/1993 | F42B 12/06 | |
| DE | 3932383 | C2 | 1/1995 | | |
| DE | 195 04 840 | A1 | 8/1996 | | |
| DE | 4028409 | C2 | 5/1997 | | |
| DE | 19948710 | A1 | 4/2001 | | |
| DE | 10 2004 005 042 | A1 | 9/2005 | | |
| DE | 10 2004 017 464 | A1 | 11/2005 | | |
| DE | 10 2007 037 702 | A1 | 2/2009 | | |
| DE | 10 2007 038 486 | A1 | 2/2009 | | |
| DE | 10 2008 049 146 | A1 | 4/2010 | | |
| DE | 10 2009 050 162 | A1 | 4/2011 | | |
| DE | 10 2007 037 699 | B4 | 10/2014 | | |
| EP | 0143775 | A2 | 6/1985 | | |
| EP | 0253058 | A1 * | 1/1988 | F42B 12/22 | |
| EP | 0156948 | B1 * | 8/1989 | F42B 12/06 | |
| EP | 0392084 | A2 | 10/1990 | | |
| EP | 1000311 | B1 | 7/2006 | | |
| WO | WO 2005/026652 | A1 | 3/2005 | | |
| WO | WO-2017060118 | A1 * | 4/2017 | F42B 12/08 | |

OTHER PUBLICATIONS

Written Opinion of the International Searching Authority in PCT/EP2016/072896 (dated 2016).*

First Office Action in CN201680058057 (dated 2019).*

* cited by examiner 15
12
18

16
16.1
12
18

17.1
17
12
18

10
14
13
3
11

PENETRATOR AND SUB-CALIBER PROJECTILE

This nonprovisional application is a continuation of International Application No. PCT/EP2016/072896, which was filed on Sep. 27, 2016, and which claims priority to German Patent Application No. 10 2015 117 018.3, which was filed in Germany on Oct. 6, 2015, and which are both herein incorporated by reference.

BACKGROUND OF THE INVENTION

Field of the Invention

The present invention relates to a penetrator and with a sub-caliber ammunition or projectile which receives the penetrator. The penetrator according to the invention is distinguished by the fact that it has an interface in the front region. It is possible via this geometric interface for a base penetrator created in accordance with the invention to be provided with different penetrator tips and supplemented to form an individually configurable KE penetrator. The base penetrator and the penetrator tips can be regarded as modules. This modular design means that it is possible, by attachment of a new module of a penetrator tip, for the penetrator to be specifically set up in relation to the target, even in situ.

Description of the Background Art

A projectile having a high penetration effect is described in EP 1 000 311 B1, which corresponds to U.S. Pat. No. 6,659,013. This projectile for combatting armored targets comprises a substantially cylindrical main body, wherein the main body has an expanding medium composed of a low-compressibility material having substantially no end ballistic effect. The expanding medium is radially enclosed by an outer body which is open at the front and which consists of a penetration material which has an end ballistic effect. When the projectile strikes a target, the expanding medium remains axially back relative to the outer body and forms a pressure zone which leads to a lateral expanding region of the outer body.

DE 10 2007 037 702 A1, which corresponds to US 2011/0176951, which is incorporated herein by reference, discloses a method and a device for producing a tubular solid body as a semifinished product for the production of a penetrator. A method for setting mechanical properties is disclosed in DE 39 32 383 C2. DE 10 2009 050 162 A1 is concerned with a damping device for installed parts in penetrators.

A fin-stabilized kinetic energy projectile is described in DE 199 48 710 B4. This comprises a penetrator made of tungsten. A sub-caliber projectile can also be found in DE 40 28 409 C2. This is distinguished by the fact that the penetrator has a predetermined breaking point in its region facing the fin assembly.

A sabot projectile having a KE penetrator is disclosed in DE 10 2008 049 146 A1. Further such projectiles are published in DE 10 2007 038 486 A1, DE 10 2007 037 699 B4, etc.

Previous attempts at optimizing the geometry and material of the KE penetrators resulted hitherto in an unwanted specialization of the ammunition. Thus, for each target, such as oblique targets, semicircular target plates, reactive armors, etc., there is a penetrator which is optimized in terms of end ballistics. Previous KE penetrators have hitherto not been able to be adapted to the different targets.

SUMMARY OF THE INVENTION

It is therefore an object of the present invention to provide an optimum adaptability of a penetrator to a plurality of targets or variants.

A universal KE projectile for medium-caliber ammunition is provided in DE 10 2004 005 042 A1, which is incorporated herein by reference. The document proposes that the advantages of a central penetrator be combined with advantages of an external penetrator. The central penetrator comprises for its part a plurality of frangible pellets which are situated behind one another, and the external penetrator comprises ductile heavy metals. This results in an improved performance in different targets.

By contrast, the present idea comprises splitting a solid penetrator in its length, in particular configuring it as two parts, with the result that the penetrator is separated or split into a so-called base part and a so-called attachment part. Here, the attachment part can be adapted or is adapted to the corresponding targets. As a result, the penetrator can also be tailored in situ to the target.

There is provision to shorten the penetrator in the front region, i.e. in the region of the penetrator tip, and to provide it with an interface or connecting point and thus to create a so-called base penetrator with interface. In addition, different penetrator tips are created which are tailored to the interface. Depending on the target, such as a semi-infinite (SI) target, oblique target or reactive armor, the loader can select a corresponding penetrator tip and attach it to the base penetrator directly before the loading operation. The final mounting of the ammunition can thus take place directly prior to firing the ammunition. The selective configuration is imparted to a fire control computer, which can then adapt the aiming operation of the weapon.

The form- and force-fitting connection of the two parts, i.e. between the base penetrator and the penetrator tip, can be realized via a threaded connection. A bayonet connection is also appropriate. Nor are adhesive connections between the base penetrator and penetrator tip excluded. Here, however, consideration should be given in particular to the internal ballistic conditions to which a projectile is exposed during firing. However, the adhesive bonding can support the threaded connection and the bayonet connection. Snap connections between the base penetrator and the penetrator tips can also be used, as known, for example, from DE 10 2004 017 464 B4, which corresponds to U.S. Pat. No. 7,819,065, which is incorporated herein by reference.

A further advantage of splitting the penetrator into base part and tip is that the length of the overall projectile can also be increased with the separately produced and separately storable penetrator tips. It is now possible for even longer penetrators to be fired, which can result in an increase in performance of the ammunition. Moreover, the penetrator tips can be produced from a material other than that of the base penetrator. Here, tungsten heavy metals, tungsten carbide, high-strength steel, copper, depleted uranium or tantalum can be used as the penetrator tip, whereas the base penetrator consists, for example, of more cost-effective steel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
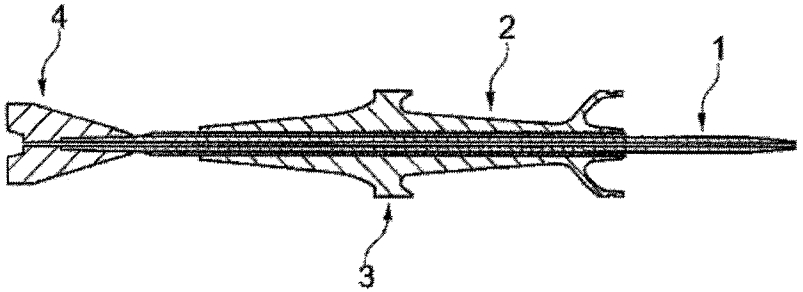
FIGS. 1 and 1*a*-1*c* show a penetrator and diverse targets according to the prior art.
Figure 1A:
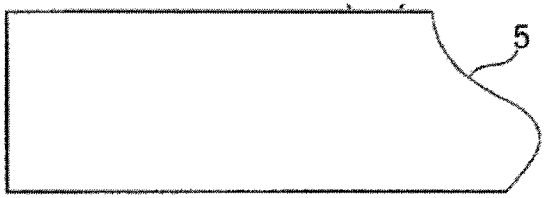
Figure 1B:
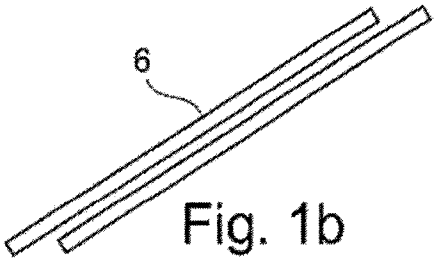
Figure 1C:
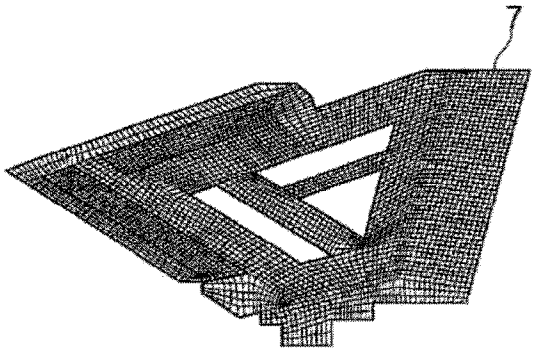
Fig. 1c (Prior Art)

FIG. 1 shows a penetrator 1 of a projectile 2 having a sabot 3 and a fin assembly 4 according to the prior art. The projectile 2, in particular the penetrator 1, are provided and correspondingly configured for different targets according to FIGS. 1*a* to 1*c*. These targets are semi-infinite (SI) targets 5, oblique targets 6 or reactive targets 7. Depending on the target 5, 6 or 7, the projectile 2 receives a penetrator 1 which is optimized for these targets.

Figures 2, 2A, 2B, 2C:
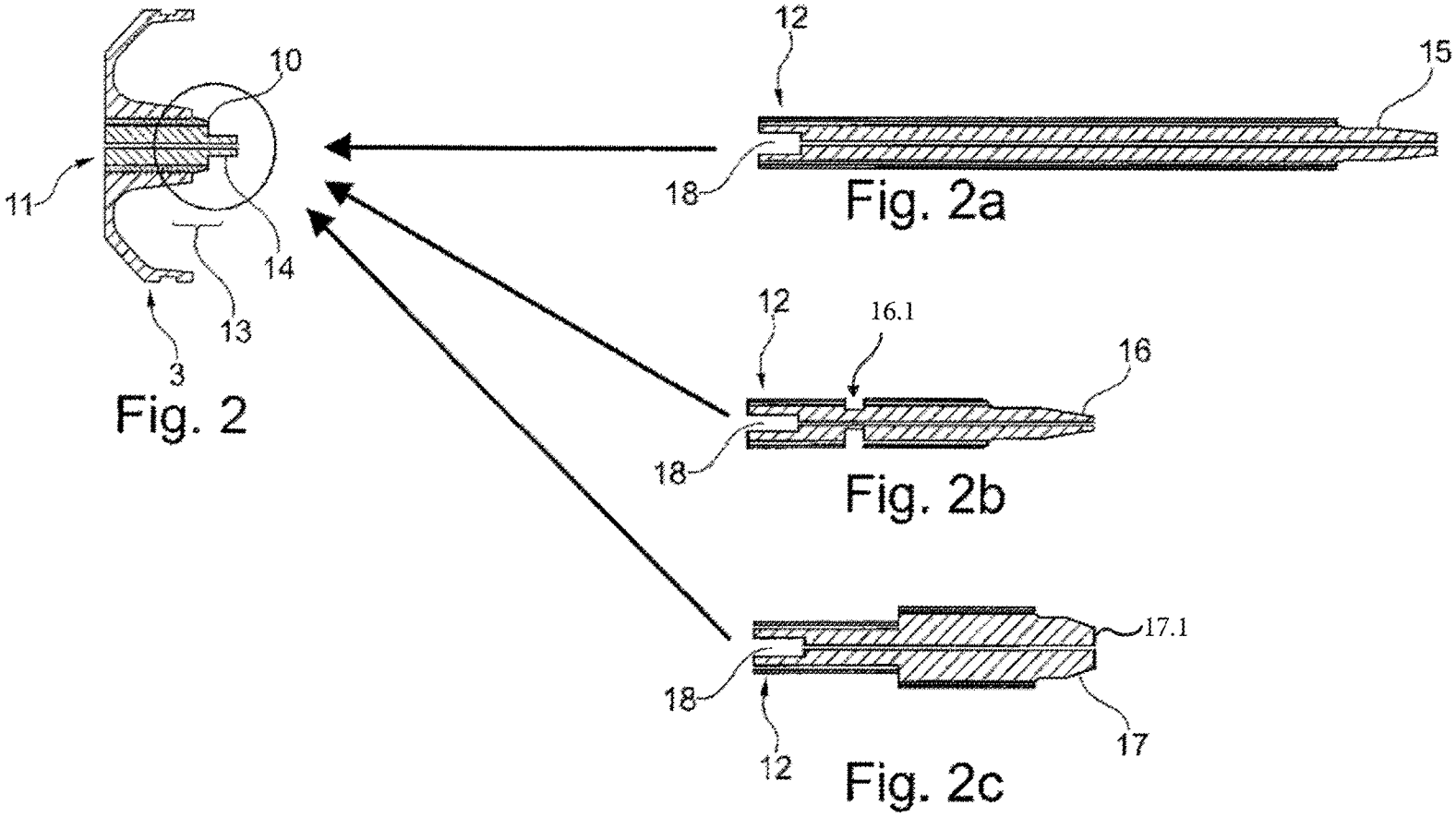
FIGS. 2 and 2*a*-2*c* show a penetrator according to the invention.

FIG. 2 shows the basic idea of the present invention.

A penetrator 10 is separated into at least two parts 11, 12 and subdivided into a base part 11 and attachment part 12. The separation preferably occurs in the front region 13 of the penetrator 10 (FIG. 2). In this region 13, the penetrator 10 is provided with an interface 14. There thus results a shortened base penetrator 11 with a defined geometric interface 14 which ends directly in front of the sabot 3. The attachment parts 12 are adapted to this interface 14. The attachment parts 12 are for their part penetrator tips 15, 16, 17, as can be seen in FIGS. 2*a* to 2*c*. These penetrator tips 15, 16, 17 are tailored to the individual targets 5, 6, 7. For an SI target 5, a relatively long penetrator tip 15 is provided. Furthermore, the penetrator tip 16 for oblique targets 6 can be provided with at least one predetermined breaking point 16.1. This has the advantage that the penetrator 10 can be deformed unimpeded up to the predetermined breaking point 16.1 of the penetrator tip 16. The penetrator tip 17 against reactive targets 7 can also be reinforced, which means that the risk of breakage upon striking the target can be reduced. Here, the reinforcement can occur only in the front tip region 17.1.

Figures 3, 3A, 3B, 3C:
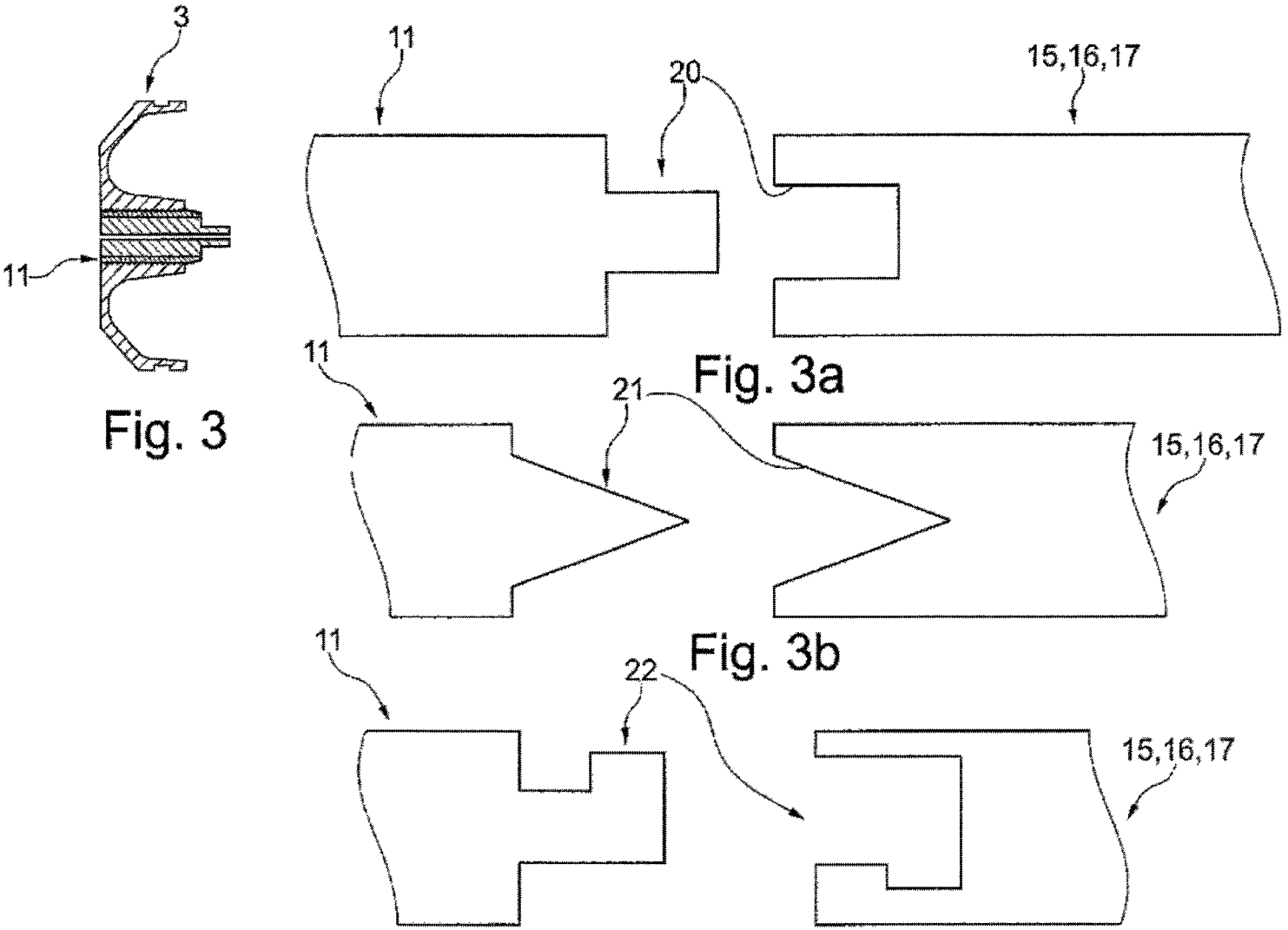
FIGS. 3 and 3*a*-3*c* shows different interfaces and connection possibilities of the penetrator according to FIG. 2.

FIG. 3 illustrates various form- and force-fitting connections 20, 21, 22 which firmly interconnect, i.e. in a form- and/or force-fitting manner, the interface 14 of the base penetrator 11 and the interface 18 of the attachment part 12. In a preferred variant, the connection 20 is realized by a thread, with it being the case that a bayonet connection 22 according to FIG. 3*c* is simpler and thus more advantageous. However, in particular cases, a better adhesive connection can also be sufficient in order to firmly interconnect the base penetrator 11 and the attachment part 12 while maintaining the functionality. At least, an adhesive can support the connection between the base penetrator 11 and the attachment parts 12.

The force fit is dependent on the ratio of the interface 14 of the base penetrator 11 and the length of the penetrator tip 15, 16, 17. However, it should be sufficient for the length of the interface 14, i.e. of the stub interacting with the attachment parts 12, to be selected to be 50% of the diameter of the penetrator 10.

The shape of the penetrator tips 15, 16, 17 is not limited to those described; rather, it can be expanded as desired. Thus, a specific tip can be defined for each target or each tank.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A penetrator for a projectile having a sabot and a fin assembly, the penetrator comprising:

a base part, having a first interface projecting from an end of the base part; and an attachment part having a second interface, wherein the first interface is received in the second interface to interconnect the base part and the attachment part in a form- and/or force-fitting manner, wherein the first interface is formed directly in front of the sabot, and wherein a length of the first interface is 50% of a diameter of the penetrator at a location at which the first interface is received in the second interface.

2. The penetrator as claimed in claim 1, wherein the first interface is incorporated in a front region of the base part.

3. The penetrator as claimed in claim 1, wherein the attachment part is a penetrator tip.

4. The penetrator as claimed in claim 3, wherein the penetrator tip is tailored to individual targets.

5. The penetrator as claimed in claim 3, wherein the base part and the penetrator tip are formed of tungsten heavy metals, tungsten carbide, high-strength steel, copper, depleted uranium, or tantalum.

6. The penetrator as claimed in claim 3, wherein the penetrator tip and the base part are different materials.

7. The penetrator as claimed in claim 3, wherein the penetrator tip is provided with at least one predetermined breaking point.

8. The penetrator as claimed in claim 3, wherein the penetrator tip is reinforced, and wherein the reinforcement is realized only in the front tip region.

9. The penetrator as claimed in claim 1, wherein the first interface and the second interface are configured as a threaded connection, as a bayonet connection, or as a snap connection.

10. The penetrator as claimed in claim 1, wherein the first interface and the second interface are connected with an adhesive.

11. The penetrator as claimed in claim 1, wherein the attachment part is one of a plurality of interchangeable attachment parts comprising:

an attachment part having a penetrator tip for an SI target;

an attachment part having a penetrator tip for an oblique target; and an attachment part having a penetrator tip for a reactive target, and wherein the interface is configured to interchangeably receive the attachment part having the penetrator tip for an SI target, the attachment part having the penetrator tip for an oblique target and the attachment part having the penetrator tip for a reactive target.

12. The penetrator according to claim 1, wherein the attachment part includes multiple penetrator tips of different length.

13. The penetrator according to claim 12, wherein the base part and the penetrator tips are modules that form the penetrator by attaching one of the penetrator tips to the base part.

14. The penetrator according to claim 1, wherein the attachment part includes multiple penetrator tips of different length, wherein the base part forms a shortened base penetrator, and wherein the base part and the penetrator tips are modules that form the penetrator by attaching one of the penetrator tips to the base part.

15. A projectile comprising:

a sabot;

a fin assembly; and the penetrator as claimed in claim 1.

16. A projectile comprising:

a sabot;

a fin assembly; and a penetrator, the penetrator comprising:

a base part, the base part having a first interface projecting from an end of the base part which is directly in front of the sabot; and an attachment part having a second interface, wherein the first interface is received in the second interface to interconnect the base part and the attachment part in a form- and/or force-fitting manner, and wherein a length of the first interface is 50% of a diameter of the penetrator at a location at which the first interface is received in the second interface.

* * * * *